US005759142A

United States Patent [19]

Perdikaris

[11] Patent Number: 5,759,142

[45] Date of Patent: Jun. 2, 1998

[54] COATED ROLL FOR ALUMINIZING PROCESSES

[75] Inventor: Chris Perdikaris, Norwalk, Calif.

[73] Assignee: Bender Machine, Inc., Vernon, Calif.

[21] Appl. No.: 799,538

[22] Filed: Feb. 12, 1997

Related U.S. Application Data

[63] Continuation of Ser. No. 375,912, Jan. 20, 1995, abandoned.

[51] Int. Cl.[6] ..... C23C 4/10

[52] U.S. Cl. ..... 492/54; 492/53

[58] Field of Search ..... 492/54, 3, 53

[56] References Cited

FOREIGN PATENT DOCUMENTS 4232245 8/1992 Japan .

*Primary Examiner*—Irene Cuda

*Attorney, Agent, or Firm*—Louis J. Bachand

[57] ABSTRACT

Aluminizing process guide roll are made longer wearing without surface defects by applying a multilayer coating on the roll surface including a first coating layer of MCrAlY metal of a first, lower porosity effective against corrosion, and a second coating layer of refractory oxide of a second higher porosity effective against surface defect failure generated thermal expansion failure of the layer.

21 Claims, No Drawings

COATED ROLL FOR ALUMINIZING PROCESSES

This application is a continuation of my application Ser. No. 08/375,912 filed Jan. 20, 1995, now abandoned, the disclosure of which is incorporated herein by this reference.

TECHNICAL FIELD

This invention relates to aluminizing processes and coated rolls useful in such processes. Aluminizing processes typically involve the application of coatings of aluminum or aluminum and zinc in desired proportions to surfaces of steel strip products to limit corrosion of such products in use. Typically the steel strip products are passed at high speed through a high temperature bath of the aluminizing coating material and guided by appropriately placed rolls immersed in the bath. The application environment for aluminizing coatings is accordingly highly aggressive with the result that the guide rolls deteriorate finally to the point where surface blemishes are left on the steel strip products by the guide rolls. Such flaws will lower the value of the steel strip product. The guide rolls are replaced periodically to avoid surface blemish problems in the steel strip product, but this step necessitates shutdown of the steel strip product processing and is costly to productivity.

The invention is particularly concerned with improvements in the coated rolls used in aluminizing processes to enable longer runs of steel strip products and increased freedom from deterioration to blemish-making conditions during the longer runs.

BACKGROUND

Guide rolls coated with previously available coatings afford only a short useful life in the difficult environment of an aluminizing bath and deteriorate in a manner causing rapid development of blemishes on the steel strip products.

SUMMARY OF THE INVENTION

It is an object of the present invention to provide novel and improved guide rolls for aluminizing processes. It is another object to provide coatings for aluminizing bath guide rolls which are slower to wear and which wear without premature appearance of blemishes on the steel strip product. It is another object of the present invention to provide guide roll coating systems having different layers of differing porosity such that the outermost layer is more porous and less subject to damaging thermal shock when immersed in a superheated aluminizing bath than the innermost coating which is of less porosity and better bonding to the guide roll surface and the outermost coating layer as well. It is a still further object to provide such a coating in which the innermost metal is an MCrAlY metal of about 1–2% porosity and the outermost coating is a refractory metal oxide of about 4–5% porosity. The invention further contemplates the method of aluminizing steel strip in which a multilayer coating as described is interposed between the guide roll surface and the steel strip in the aluminizing bath.

These and other objects of the invention to become apparent hereinafter are realized in a long wearing guide roll for guiding steel strip through a high temperature aluminizing bath, the roll comprising a roll body having a surface in guiding contact with the steel strip within the bath and a multilayer coating interposed between the roll surface and the steel strip in contact, the multilayer coating including a first layer comprising MCrAlY metal in which M is Ni or Co, and a second layer comprising a refractory metal oxide of Al, Zr, Si or Cr, the second layer having a higher porosity than the first layer to better accommodate thermal expansion coincident with bath immersion without blemish-creating disruption of the second layer surface while the less porous MCrAlY metal first layer maintains effective oxidation protection of the roll surface.

In this and like embodiments, preferably, the M in MCrAlY is nickel or cobalt, the first coating layer has a thickness in the range of 0.004 to 0.006 inch, the second coating layer has a thickness in the range of 0.012 to 0.022 inch, the first coating layer has a porosity in the range of 1–2%, the second coating layer has a porosity in the range of 4–5%, the refractory oxide comprises an oxide of Zr, Cr, Al or Si.

In other embodiments, the long wearing guide roll also includes between the first and second layer in the multilayer coating an intermediate coating layer comprising a mixture of MCrAlY metal and refractory oxide.

In a more particularly preferred embodiment, there is provided a long wearing guide roll for guiding steel strip through a high temperature aluminizing bath, the roll comprising a roll body having a surface in guiding contact with the steel strip within the bath and a multilayer coating interposed between the roll surface and the steel strip in contact, the multilayer coating including a first layer comprising MCrAlY metal in which M is Ni or Co, a second layer comprising a refractory metal oxide of Al, Zr, Si or Cr, and a third layer intermediate the first and second layer comprising a mixture of MCrAlY and refractory metal oxide in a weight ratio between 10 to 90 and 90 to 10 of the MCrAlY to the oxide, the second layer having a higher porosity than the first layer to better accommodate thermal expansion coincident with bath immersion without disruption of the second layer surface while the less porous MCrAlY metal first layer maintains effective oxidation protection of the roll surface.

In this as in previous embodiments, preferably, the first coating layer has a thickness in the range of 0.004 to 0.006 inch, and the second coating layer has a thickness in the range of 0.012 to 0.022 inch, the first coating layer has a porosity in the range of 1–2%, and the second coating layer has a porosity in the range of 4–5%, the refractory oxide comprises an oxide of Zr or Al.

As noted the invention further contemplates the method protecting aluminizing process guide rolls from generation of surface defects in immersed rolling contact with steel strip including interposing a relatively more porous coating overlayer comprising refractory metal oxide and a relatively less porous coating under layer comprising MCrAlY metal in which M is Ni or Co on the guide roll surface between the surface and the steel strip.

DETAILED DESCRIPTION

The porosity value for the invention coating layers may be estimated after considerable experience with various coating compositions and methods. Benchmark coating porosity values for such subsequent estimates may be obtained by photographing a cross-section of the coating under measurement, magnifying the image 500 times with a microscope, staining the void portions, and measuring the stained area with an image analyzer. See U.S. Pat. No. 4,912,835 to Harada et al.

In the invention the MCrAlY metals used preferably have Co or Ni as M and are typically thermal spray materials of suitable composition for obtaining the indicated 1–2% porosity by thermal spraying of the metal to the indicated thickness by known techniques. The refractory oxides are likewise of suitable composition for thermal spraying to the indicated thickness and porosity of 4–5%. It is required in the invention that the two coating materials be applied in sequence and that the porosity of the outer coating be maintained greater than the inner coating. In this manner the oxidation resistant qualities of the MCrAlY metals are maintained and the erosion resistant qualities of the refractory oxides are realized as well, while avoiding the blemish producing disruptions of the outer surface layer coincident with unaccommodated thermal expansion response when the coated roll is placed in the aluminizing bath.

In certain instances it is desirable to add an intermediate coating between the first coating and the second coating. This intermediate coating is of like composition to the coatings on either side and may typically comprise from 25% to 75% of the first or inner coating composition and from 75% to 25% of the second or outer coating or be of other composition complementary to the inner and outer coatings and facilitating of bonding and adhesion between the coating layers initially and in use conditions. Intermediate coating thicknesses will range between 0.006 and 0.010 inch or more or less for particular purposes and compositions.

EXAMPLES

Example 1

All parts and percentages herein are by weight. Porosity was visually measured. An aluminizing guide roll body 8 feet long and about 2 feet in diameter, comprised of 300 or 400 stainless steel and intended for service in a 1325° F. 100% aluminum aluminizing bath for steel strip was cleaned of previous coatings, trued and smoothed. The roll body was mounted for rotation before a commercial thermal spray gun and sprayed with Praxair CO-159 MCrAlY (M is cobalt) to a depth of 0.006 inch. Other thicknesses of inner or first coating layer from 0.004 inch may also be used. The inner coating is sprayed under conditions relative to the composition which produce a high proportion of fully melted particles so as to minimize porosity into the 1–2% range. Thereafter a refractory oxide is applied. First, however, an intermediate layer is next applied under the same thermal spray arrangement, but using a 50% MCrAlY and 50% intimate blend by volume (by weight 65% CO-159 and 35% of a mixture of 25% $Al_2O_3$ and 75% $ZrO_2$ refractory oxides as the sprayed material. The depth of the intermediate coating layer is typically 0.008 inch. Then the refractory oxide blend is applied as the outer layer by thermal spray application to achieve less melting of the particles and thus a higher porosity in the range of 4–5%. The outer layer has a typical thickness of 0.013 inch.

The roll is preheated and immersed in a aluminizing bath maintained at a temperature of approximately 1325° F. Evaluation of the several coated roll bodies made according to the invention in the aluminizing bath after passing steel strip over the body at about 400 surface feet per minute for reveals that the roll body functions without causing surface imperfections in the strip surface wearing unduly at the contact area for a minimum eighteen 8 hour shifts and up to forty-five 8 hour shifts. This contrasts with previous roll bodies having conventional coating systems and not dual porosity in separate inner and outer layers of typically three to nine 8 hour shifts. The invention multilayer coating greatly multiplied the useful life of the guide roll.

Example 2

Example 1 is duplicated omitting the intermediate layer and maintaining the inner and outer layers the same porosity and thickness. Results are equivalent

Example 3

Example 1 is duplicated with an inner layer thickness of 0.004 inch of Metco 443 MCrAlY metal (M is Ni) and an outer layer thickness of 0.022 inch of zirconium oxide refractory. Results are equivalent.

Control

Example 1 was duplicated but substituting a cermet coating comprising tungsten carbide and 12% cobalt for the invention coating system. The coating failed, caused defects in the steel strip, after only 3 hours i.e. less than one-half an 8 hour shift.

I claim:

1. A long wearing guide roll for guiding steel strip through a high temperature aluminizing bath, said roll comprising a roll body having a surface in guiding contact with said steel strip within said bath and a multilayer coating directly on said roll surface for contact with said steel strip, said multilayer coating including a first layer directly against said roll surface, said first layer comprising MCrAlY metal in which M is Ni or Co, said MCrAlY metal being thermally sprayed directly onto said roll surface free of any bonding layer between the thermally sprayed MCrAlY first layer and said roll surface and a second layer thermally sprayed onto said MCrAlY first layer, said second layer comprising a refractory metal oxide of Al, Zr, Si or Cr, said second layer having a higher porosity than said first layer to better accommodate thermal expansion coincident with bath immersion without disruption of the second layer surface while the less porous MCrAlY metal first layer maintains effective oxidation protection of said roll surface.

2. The long wearing guide roll according to claim 1, in which M in MCrAlY is nickel.

3. The long wearing guide roll according to claim 1, in which M in MCrAlY is cobalt.

4. The long wearing guide roll according to claim 1, in which said first coating layer has a thickness in the range of 0.004 to 0.006 inch.

5. The long wearing guide roll according to claim 1, in which said second coating layer has a thickness in the range of 0.012 to 0.022 inch.

6. The long wearing guide roll according to claim 1, in which said first coating layer has a porosity in the range of 1–2%.

7. The long wearing guide roll according to claim 1, in which said second coating layer has a porosity in the range of 4–5%.

8. The long wearing guide roll according to claim 1, in which said refractory oxide comprises an oxide of Zr.

9. The long wearing guide roll according to claim 1, in which said refractory oxide comprises an oxide of Cr.

10. The long wearing guide roll according to claim 1, in which said refractory oxide comprises an oxide of Al.

11. The long wearing guide roll according to claim 1, in which said refractory oxide comprises an oxide of Si.

12. The long wearing guide roll according to claim 1, in which said first layer has a thickness of 0.004 to 0.006 inch, a porosity of 1–2%, and said first layer comprises MCrAlY in which M is nickel or cobalt.

13. The long wearing guide roll according to claim 1, in which said second layer has a thickness of 0.012 to 0.022 inch, a porosity of 4–5%, and said second layer comprises a refractory oxide of Zr or Al.

14. The long wearing guide roll according to claim 1, in which said first layer has a thickness of 0.004 to 0.006 inch, a porosity of 1–2%, and said first layer comprises MCrAlY in which M is nickel or cobalt.

15. The long wearing guide roll according to claim 14, including also between said first and second layer in said multilayer coating an intermediate coating layer comprising a mixture of MCrAlY metal and refractory oxide.

16. A long wearing guide roll for guiding steel strip through a high temperature aluminizing bath, said roll comprising a roll body having a surface in guiding contact with said steel strip within said bath and a multilayer coating directly on said roll surface for contact with said steel strip, said multilayer coating including a thermally sprayed first layer comprising MCrAlY metal in which M is Ni or Co, said first layer being sprayed directly onto said roll surface and applied with a maximum porosity of 1–2% a second layer thermally sprayed onto said first layer and comprising a refractory metal oxide of Al, Zr, Si or Cr, and a third layer intermediate said first and second layer comprising a mixture of MCrAlY and refractory metal oxide in a weight ratio between 10 to 90 and 90 to 10 of the MCrAlY to the oxide, said second layer being thermally sprayed and having a higher porosity than said first layer to better accommodate thermal expansion coincident with bath immersion without disruption of the second layer surface while the less porous MCrAlY metal first layer maintains effective oxidation protection of said roll surface.

17. The long wearing guide roll according to claim 16, in which said first coating layer has a thickness in the range of 0.004 to 0.006 inch, and said second coating layer has a thickness in the range of 0.012 to 0.022 inch.

18. The long wearing guide roll according to claim 16, in which said second coating layer has a porosity in the range of 4–5%.

19. The long wearing guide roll according to claim 1, in which said refractory oxide comprises an oxide of Zr or Al.

20. The long wearing guide roll according to claim 18, in which said first coating layer has a thickness of 0.004 to 0.006 inch and said second coating layer has a thickness in the range of 0.012 to 0.022 inch.

21. Method of protecting aluminizing process guide rolls from generation of surface defects in aluminizing-bath-immersed rolling contact with steel strip including thermally spraying a relatively more porous coating over layer having 4–5% porosity and comprising refractory metal oxide and a relatively less porous coating under layer having 1–2% porosity and comprising MCrAlY metal in which M is Ni or Co on the guide roll surface between said surface and said steel strip, said under layer being directly on said surface, and thereafter subjecting said roll surface to said rolling contact.

* * * * *